United States Patent [19]

Strewe et al.

[11] 3,930,978

[45] Jan. 6, 1976

[54] CIRCUIT OF ELECTROLYTIC CELLS

[75] Inventors: Wolfgang Strewe, Dortmund; Luciano Mosé, Dortmund-Hoechsten; Wolfgang Kramer, Herdecke; Bernd Strasser, Hamm, all of Germany

[73] Assignee: Friedrich Uhde GmbH, Dortmund, Germany

[22] Filed: Jan. 20, 1975

[21] Appl. No.: 542,650

[30] Foreign Application Priority Data

Oct. 9, 1974 Germany ..... 2448194

[52] U.S. Cl. ..... 204/228; 204/267

[51] Int. Cl.[2] ..... C25B 9/04

[58] Field of Search ..... 204/228, 98, 128, 243 M, 204/244, 267, 253

[56] References Cited

UNITED STATES PATENTS 2,649,510 8/1953 Michaelis ..... 204/228 X

FOREIGN PATENTS OR APPLICATIONS 1,077,436 3/1960 Germany ..... 204/228

2,055,161 5/1971 Germany ..... 204/228

*Primary Examiner*—G. L. Kaplan

*Attorney, Agent, or Firm*—Peter F. Casella; Herbert W. Mylius

[57] ABSTRACT

A novel circuit of electrolytic cells comprising novel electrolytic cells, novel jumper switches and novel arrangement of the jumper switches referring to the electrolytic cells which enable the novel circuit to be designed to operate at high current capacities upward to about 500,000 amperes while maintaining high operating efficiencies. These high current capacities provide for high production capacities which result in high production rates for given cell room floor areas and reduce capital investment and operating costs.

8 Claims, 11 Drawing Figures

CIRCUIT OF ELECTROLYTIC CELLS

BACKGROUND OF THE INVENTION

This invention relates to a circuit of electrolytic cells suited with vertical electrodes for the electrolysis of aqueous solutions. More particularly, this invention relates to a circuit of electrolytic cells suited for the electrolysis of aqueous alkali metal chloride solutions.

Electrolytic cells arranged as a circuit have been used extensively for many years for the production of chlorine, chlorates, chlorites, caustic, hydrogen and other related chemicals. Over the years, such cells circuits have been developed to a degree whereby high operating efficiencies have been obtained, based on the electricity expended. Operating efficiencies include current, voltage and power. The most recent developments in electrolytic cells circuit have been in making improvements for increasing the production capacities of the individual cells while maintaining high operating efficiencies. This has been done to a large extent by modifying or redesigning the individual cells and increasing the current capacities at which the individual cells operate. The increased production capacities of the individual cells operating at higher current capacities provide higher production rates for given cell room floor areas and reduce capital investment and operating costs.

Circuit of electrolytic cells means a plurality of cells, which are electrically connected in series with a direct current power supply and which are arranged in one or more rows and are equipped with at least one portable jumper switch.

In general, the most recent developments in circuits of electrolytic cells have been towards larger cells which have high production capacities and which are designed to operate at high current capacities while maintaining high operating efficiencies. Within certain operating parameters, the higher the current capacity at which a cell is designed to operate, the higher is the production capacity of the cell. As the designed current capacity of a cell is increased, however, it is important that high operating efficiencies be maintained. Mere enlargement of the component parts of a cell designed to operate at low current capacity will not provide a cell which can be operated at high current capacity and still maintain high operating efficiencies. Numerous design improvements must be incorporated into a high current capacity cell so that high operating efficiencies can be maintained and high production capacity can be provided.

Circuits of electrolytic cells for making chlorine and caustic soda is of primary importance and will be used to exemplify our invention. Table I shows the development.

| | | | | |
|---|---|---|---|---|
| current | KA | 80° | 150 | 200 |
| cell width | m ca. | 1.6 | 2.3 | 3.0 |
| cell length | m ca. | 1.9 | 2.2 | 2.2 |
| chlorine production t/day | | 2.4 | 4.5 | 6.0 |

In the early prior art, chlor-alkali diaphragm cell circuits were designed to operate at the above mentioned current capacities having the shown production capacities.

Conventional circuits of electrolytic cells consist in a plurality of series-connected cells, normally arranged in two more rows. The cells are rated for a current up to about 150,000 Amps. The limited life time of certain cell parts, such as anodes, seperators respectively diaphragms, requires the removal of each cell from time to time and transportation of this cell to a workshop for the renewal of the spent or exhausted cell parts. Normally such cell circuits are equipped with one or more portable jumper switches for bypassing the electrical current around each incapacitated cell to the two adjacent cells, thus allowing steady operation of the cell circuit without any interruptions due to the incapacity of a cell.

In conventional cell circuits for bypassing a cell the jumper switch is positioned in an operation aisle in front of that cell and is electrically connected by means of busbars or cables to the cathode part of an adjacent cell and the anode part of the other adjacent cell. It is necessary to equip each cell with special means for the connection to the switch. By the positioning of the switch beside the cell row the current distribution in the adjacent cells is distubed.

As illustrated in FIG. -2- cell parts next to the operation aisle, where the switch is positioned, have to carry a higher electric load than normal, where as in the opposite cell parts the current is discharged. This uneven current distribution results in higher heat generation of overloaded cell parts, higher power consumption and lower current efficiency. Due to the fact of uneven current distribution in the switch-connected cells the length of the cells in conventional circuits is very limited. In conventional circuits of vertical-electrode cells the usual aspect ratio of cell length to cell width is about 2 or less. Regarding to this invention, cell length means the horizontal extension of the electrolytic chamber of the cell rectangular to the direction of the cell row and cell width means the horizontal extension of the electrolytic chamber of the cell in the direction of the cell row.

In conventional circuits of vertical electrode cells the jumper switch is located on the same level as the cells. For transportation of the incapacitated cell to the workshop the cell must be lifted by a crane over the switch or over the adjacent cells resulting in an enlarged construction height of the cell house building to accommodate the crane.

The above description of the prior art shows the development of chlor-alkali diaphragm cell circuits design to operate at higher current capacities with correspondingly higher production capacities. Chlor-alkali diaphragm cell circuits have now been developed which operate at high current capacities of about 150,000 amperes and upward to about 200,000 amperes with correspondingly higher production capacities while maintaining high operating efficiencies.

Nevertheless the circuits of electrolytic cells of the prior art are still subject to some disadvantages, which influence efficiencies, operating costs and capital investment and which prevent further increasing of cell current and production rates.

SUMMARY OF THE INVENTION

It is the purpose of this invention to avoid disadvantages of conventional circuits of electrolytic cells due to the positioning of the jumper switch beside the cell rows in the operation aisle and to enlarge cell size and thus cell loads and product capacities by enlargement of the aspect ratio up to 8 or more while maintaining an equal current distribution in each cell regardless whether connected with the adjacent cell or whether connected with the jumper switch.

In accordance with the present invention, there is provided a novel circuit of electrolytic cells. The novel circuit of electrolytic cells comprises novel electrolytic cells having novel anode lead-in and cathode lead-out busbars, which are preferably uniformly disposed across substantially the entire length of the cell, a novel jumper switch, and a novel arrangement of the cells to the jumper switch.

The novel circuit of electrolytic cells comprises at least one row of a plurality of electrolytic cells whose length is at least twice as long as its width. The cells being disposed in row so that the anode lead-in and cathode lead-out are disposed along the length of each cell. The cell circuit contains at least one portable jumper switch located beneath the row of cells. The portable jumper switch has anode- and cathode-connections at opposite sides and uniformly disposed across substantially its entire length corresponding to the cell length. The novel circuit allows that a cell may be taken out of service by means of the jumper switch without interrupting the continuous operation of the other cells in the circuit. The portable jumper switch, located beneath the row of cells ensures that the electric current flows through the jumper switch from one cell to the other cell connected to the jumper switch in a straight line when viewed from the top.

Essential for this invention is the installation of a portable jumper switch beneath a cell row in its center line, as shown in FIG. 3, the adjustment of the length of the switch to the length of the cell allowing a short and straight-lined connection between the electrode elements of the one cell connected to the switch over a plurality of switch connectors and a plurality of switch contacts to the corresponding electrode elements of the other cell connected to the switch. In comparison to conventional cell circuits the new concept of this invention involves various advantages. Due to the position of the jumper switch in the center line of the cell row, due to the extension of the switch over the total cell length and due to the plurality of switch connectors and switch contacts extended over the total cell length any disturbance of the current flow in the switch connected cells occuring unnormal and bad operation conditions are avoided; fully independent on the length of the cell. The effect of any desired prolongation of the cell and the jumper switch allows scaling up of cells and switches to vary high capacities, such as 300,000, 400,000 Amp. or even more with the consequence of according higher production rates of such cells, and savings of capital investment.

The possibility of such prolongation of cells and switches furthermore allows to design the cells for narrow width and long length, resulting in a high aspect ratio of cell length to cell width while maintaining high current and high production rates. The reduction of the cell width while maintaining high production rates is very advantageous because of the reduction of the path of the current to each cell and inside each cell, thus reducing the total path of the current in the circuit as shown in FIGS. 6 and 7. This reduction of the total current path of a circuit results in substantial savings in material for electrical conduction and reduced losses of electrical power in the circuit.

Additional advantages of the present invention are: good accessibility of all cells from beneath, good ventilation of the cell room, omission of water cooling means for overloaded cell parts of the switch connected cells, omission of additional busbars for the switch connection at each cell.

The novel circuit of electrolytic cells arrangement makes the most economic use of invested capital, namely, the amount of highly conductive metal used in the busbar structure. The configuration and different relative dimensions of the lead-in busbar and lead-out busbars and the plurality of busbar strips significantly reduce the amount of conductive metal required in the busbar structure as compared to the prior art. Lead-out busbars and the plurality of intercell connectors by means of their configuration and different relative dimensions are adapted to carry the electric current from cell to cell as well as from cell to switch without additional requirements of conductive material.

The novel electrolytic cell circuit comprises a circuit of chlor-alkali electrolytic cells wherein the anode lead-in and cathode lead-out are provided with separate electrical contact areas for the cell to cell connection and for the cell to jumper switch connection.

The anode lead-in and cathode lead-out be provided evenly disposed across substantially the entire length of the cell.

The novel circuit of electrolytic cells of the present invention may be used in many different electrolytic processes. The electrolysis of aqueous alkali metal chloride solutions is of primary importance and the circuit of electrolytic cells of the present invention will be described more particularly with respect to this type of process. However, such description is not intended to be understood as limiting the usefulness of the circuit of electrolytic cells of the present invention or any of the claims covering the circuit of electrolytic cells of the present invention.

DESCRIPTION OF THE DRAWINGS

The present invention will be more fully described by reference of the drawings in which is

FIG. 1 illustrates an arrangement of a circuit of electrolytic cells 1, which are connected electrically by means of intercell busbars 3 in series and where the first and the last cell is electrically connected with the direct current supply 2. The cells are installed in straight rows, for the electrical connection between the rows there are provided cross over busbars 4. The number of cell rows is variable, for instance, 2, 4 or 6 rows.

In FIG. 2 the positioning of the jumper switch 5 and its connection with means of the switch connectors 6 to the cells in a conventional cell circuit is shown. It is evident, that the current distribution in the switch-connected cells is uneven, as indicated by the arrows of 7 in these cells. Furthermore the transport of an incapacitated cell or a renewaled cell between cell room and workshop is shown. It is evident that the crane 8 has to lift the cell over the top of the jumper switch 5 or the cells in the cell rows.

In comparison to the prior art FIG. 3 shows the arrangement of the jumper switch 5 to cells in a cell circuit of this invention. The portable jumper switch 5 can be moved beneath a cell row exactly adjusted to the centre line of the row and can be positioned under each cell of the row to bypass this cell electrically. It is evident that the current distribution in the switch connected cells is very even, illustrated by the straight direction of the arrows 7 in these cells thus avoiding any disturbances of current distribution and related disadvantages. This is provided by the described arrangement of the switch and by the special switch construction, that means the adjustment of the length of the switch to the length of the cell and by the plurality of the switch connectors 6 extended over the total length of the switch respectively cell.

Figure 1:
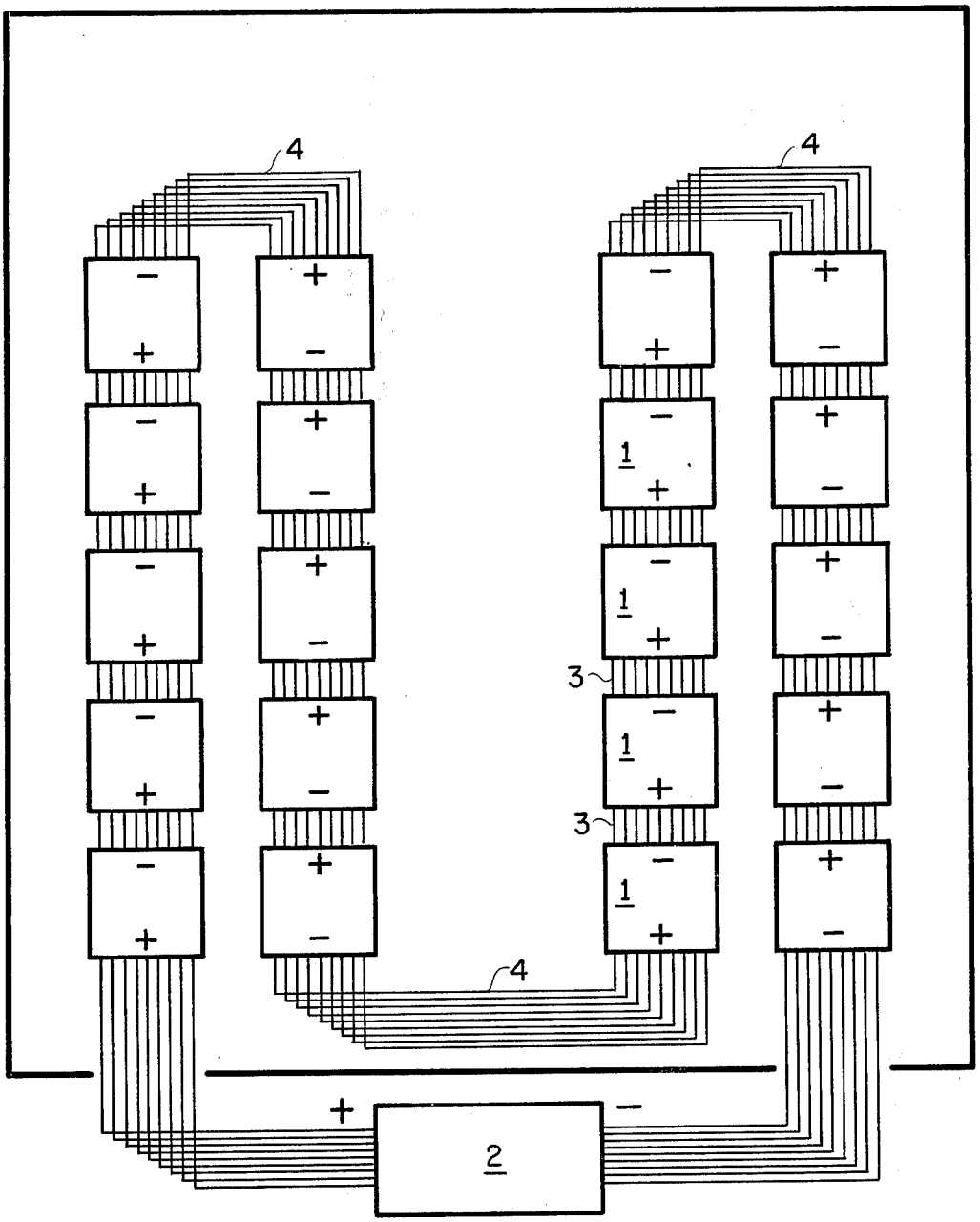
FIG. 1: Typical cell circuit
Figure 3:
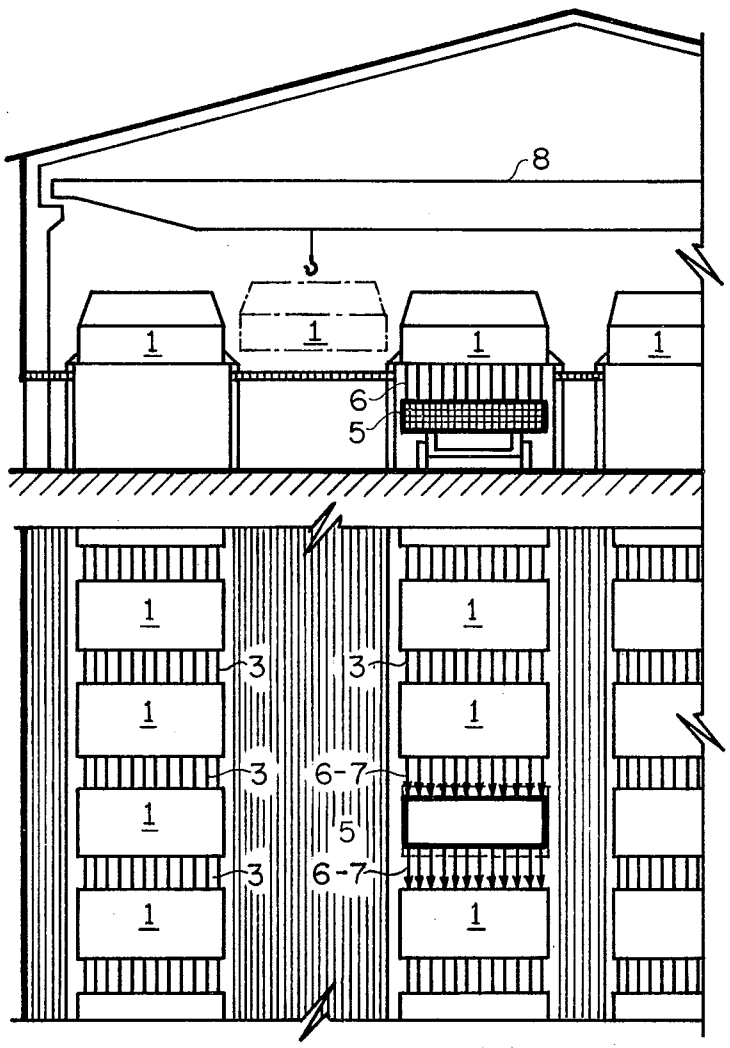
FIGS. 2 and 3: Comparison, of switch to cell arrangement in cell room of prior art and of this invention (top view and transversal section)
Figure 2:
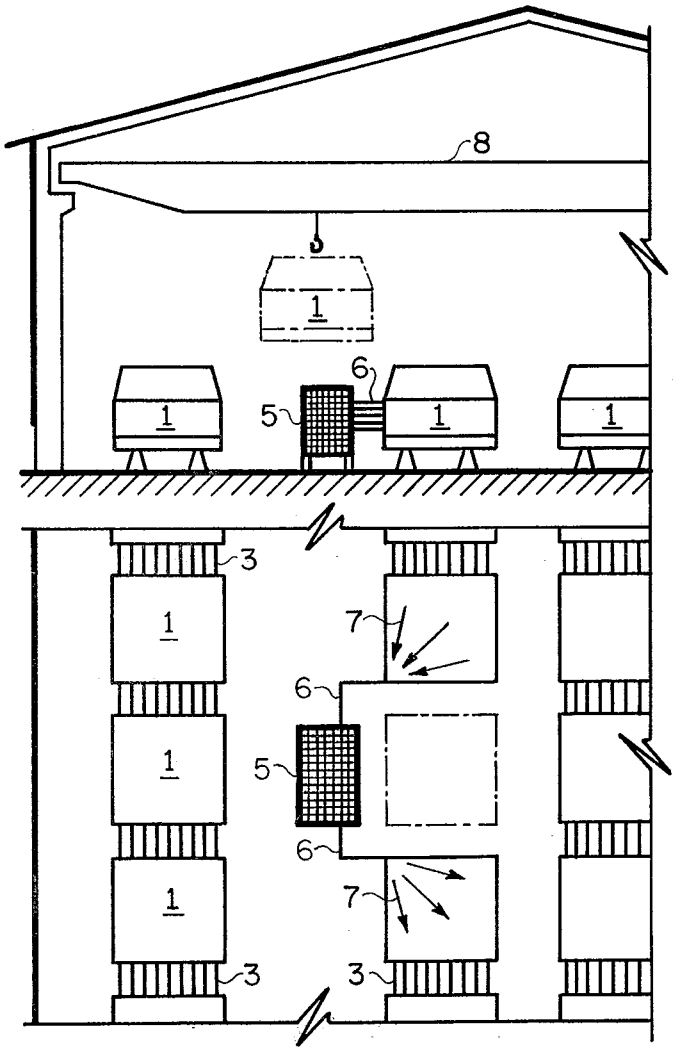
Figure 4:
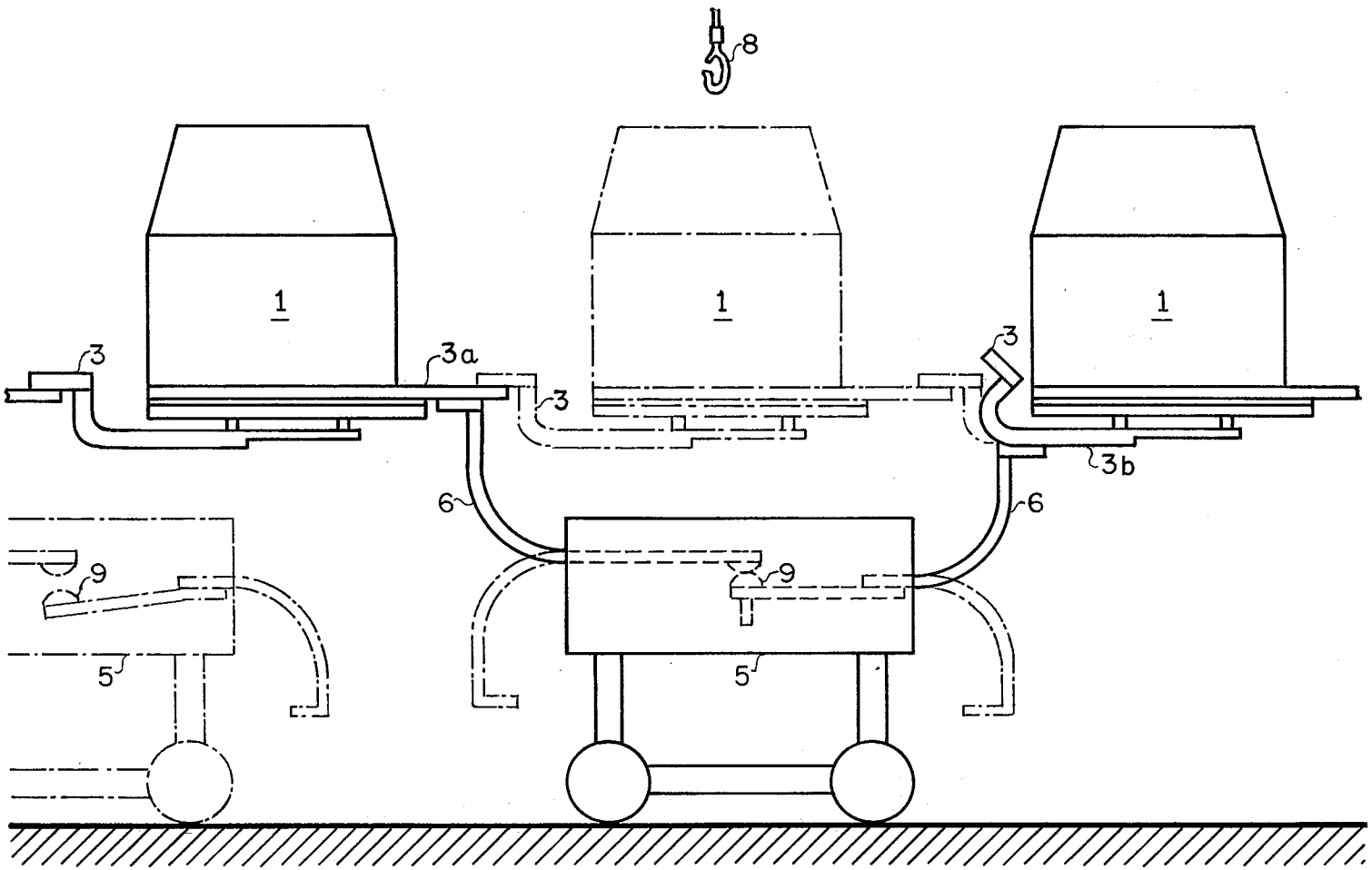
FIG. 4: Longitudinal view of switch to cell arrangement of this invention

The arrangement of switch to cells and their connection in cells circuit of this invention is illustrated in detail in FIG. 4 in lonitudinal view to a cell row and the switch installed beneath. The portable jumper switch 5 is moved beneath the cell determined for switch off. The contacts 9 are in "off" position. Then, the plurality of the switch connectors 6 are attached to contact areas 3*a* at the cathode part of the one and contact areas 3 *b* at the anode part of the other adjacent cell. By conventional automatic devices for example activators then the switch 9 will be closed so the bypassed cell is interrupted from the current of the circuit. Then the plurality of the flexible intercell. busbars 3 between the incapacitated cell and the adjacent cells is disconnected so that the incapacitated cell can be removed and a renewable cell can be installed without any interruption or disturbance of the operation of the other cells of the circuit. The necessary maintenance operations before switching the new cell into the circuit is provided by the inverse sequence of the above description.

Figure 5:
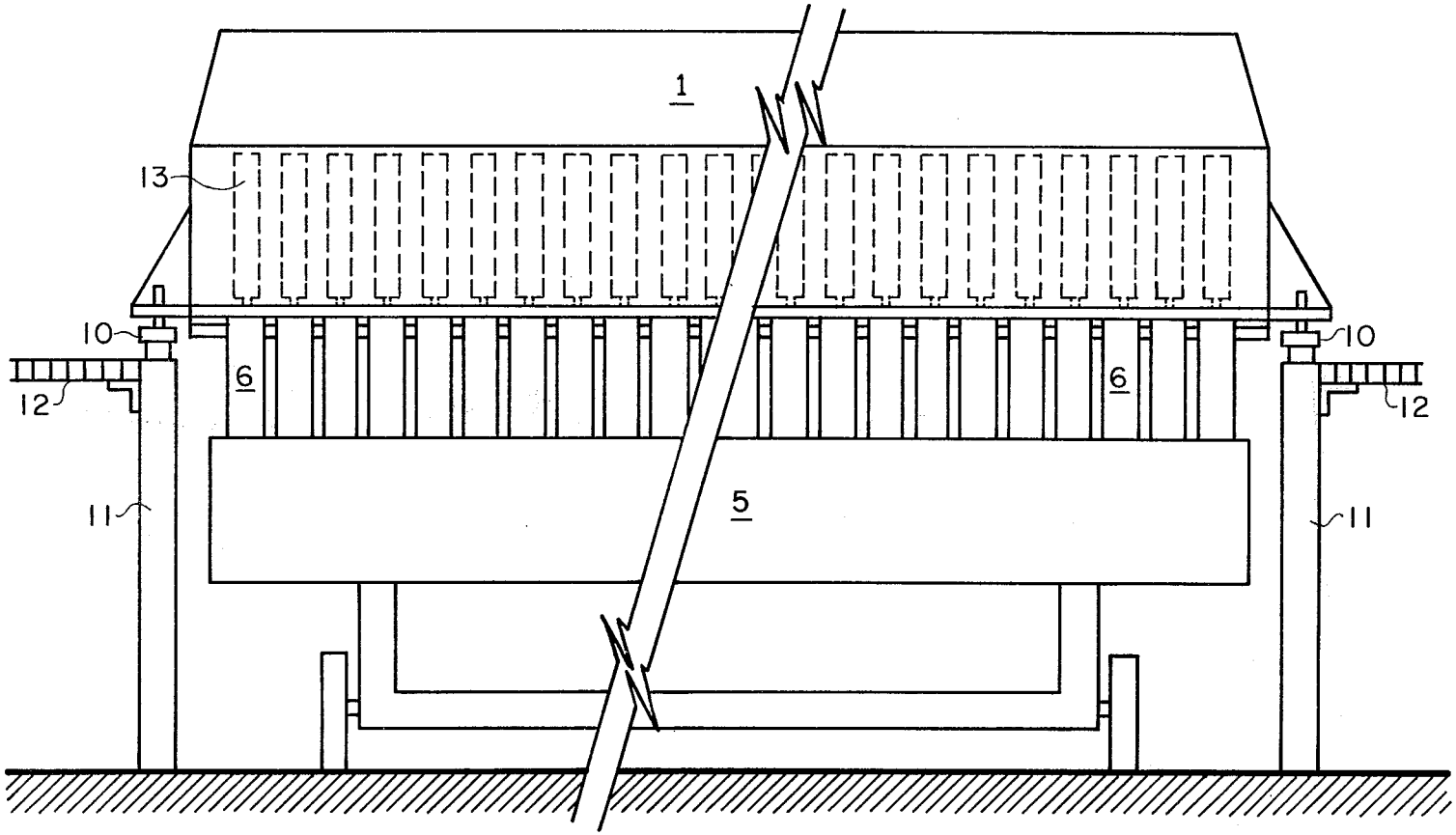
FIG. 5: Transversal view of switch to cell arrangement of this invention

In FIG. 5 *a* transversal view of the cell with its support means and the switch installed beneath this cell is shown. In contradiction to conventional electrolytic cells the support structure of the cell of this invention is not provided beneath the cell, but outside the cell wall enclosure. For this purpose at the outside of the wall enclosure current insulated and adjustable bases 10 are provided, these bases 10 are supported on pillars 11. The pillars 11 can be used as supporting means of the cell gangway 12 too. The pillars 11 are provided in a height, sufficient for the necessary operation of the switch beneath the cell row. It is further shown, that the length of the switch 5 is adjusted to the length of the cell 1, more particularly, that the plurality of the switch connectors 6 is adjusted to the plurality of electrode elements 13 thus allowing a straight current flow between each electrode element and the corresponding switch connector.

Figure 6:
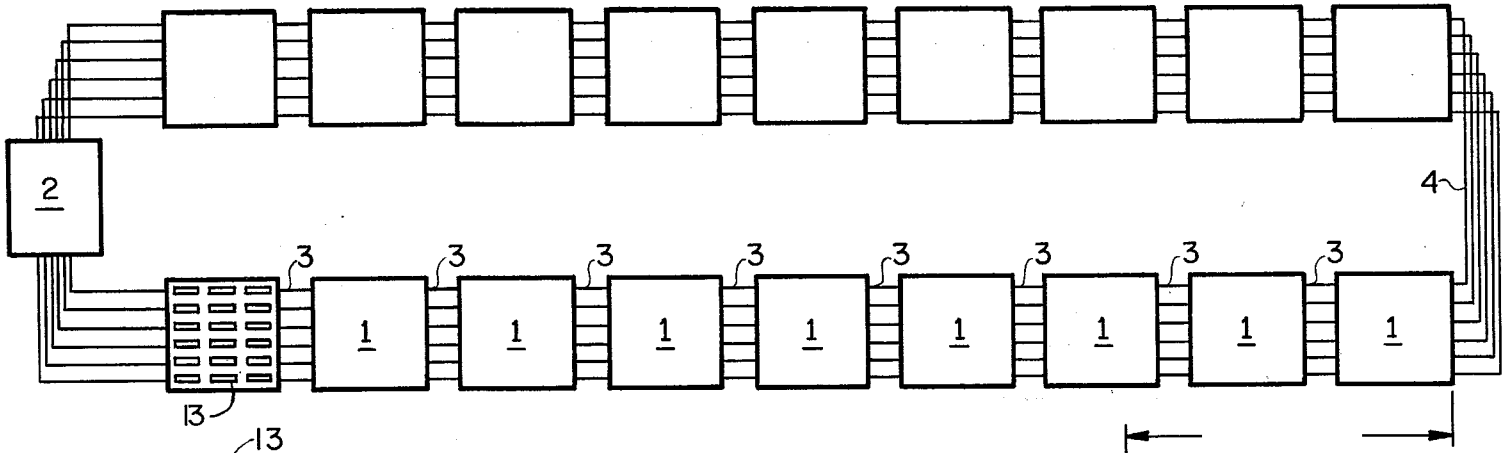
FIGS. 6 and 7: Comparison of current circuit of prior art and this invention

FIG. 6 shows a circuit of electrolytic cells with vertical electrodes with conventional aspect ratio of cell length to cell width.

Figure 7:
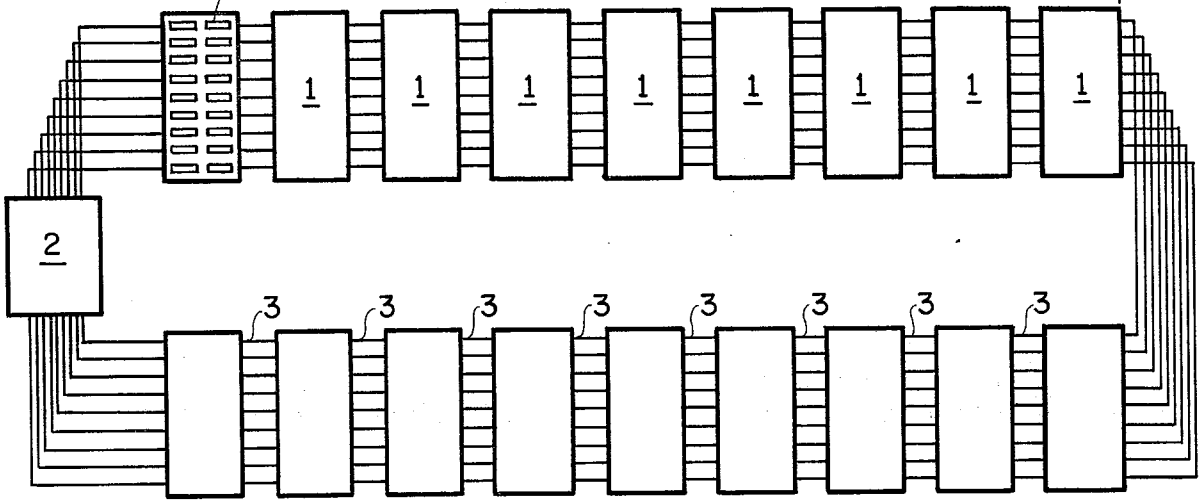

FIG. 7 shows a circuit of electrolytic cells with vertical electrodes of this invention, with the same number of cell, same number of electrode elements 13 per cell, same current as the circuit in FIG. 6, thus representing the same production rate, but with enlarged aspect ratio of cell length to cell width. It is evident that by this modification of the cell geometry the total length of the current flow between the output terminal of the power supply 2 through the cells and back to the input terminal of the power supply is substantial decreased in comparison to cell circuits of the prior art. This new geometrical cell circuit configuration results in significant savings of current conductor material as well as electric power, the more, the higher the number of installed cells is.

Figure 8:
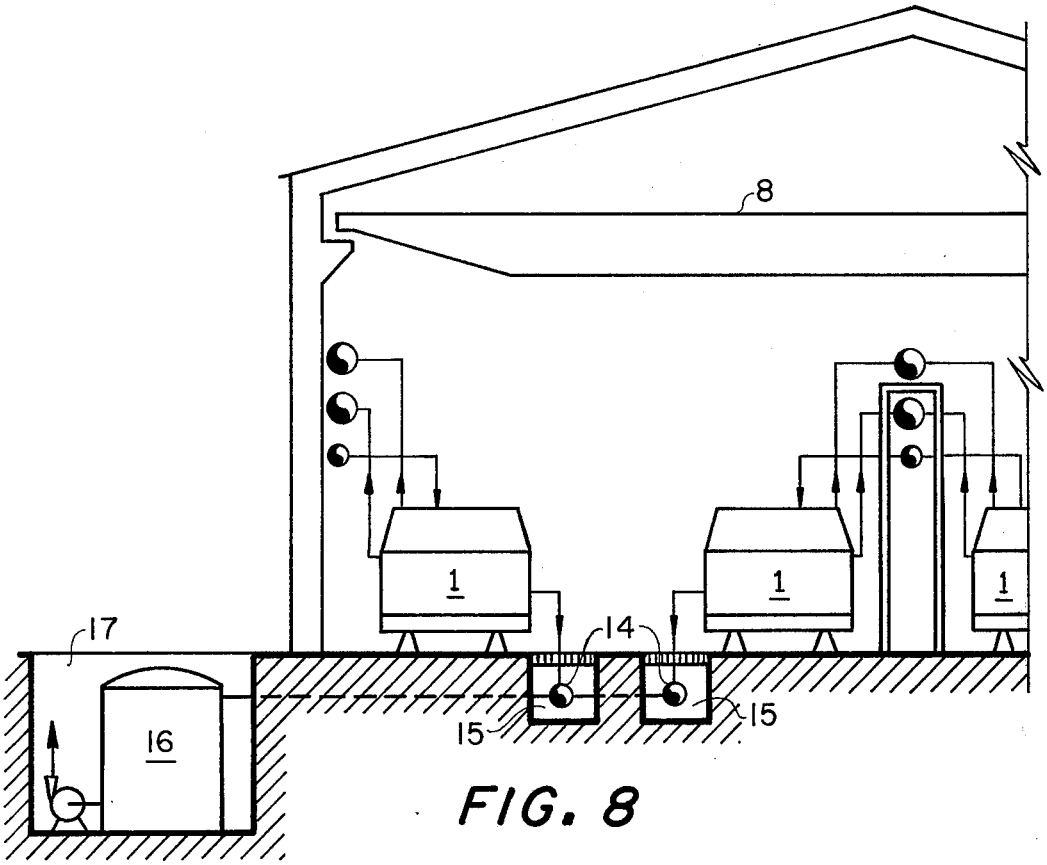
FIGS. 8 and 9: Comparison of cell room piping of prior art and this invention

FIG. 8 illustrates a transversal section of a conventional cell room, with the cells positioned on the floor. The liquid cell products flow by gravity from the cells to a collecting tank. Due to the low position of the cells the liquor pipes 14 must be installed in trenches 15 whose depths depend on the length of a cell row and the collecting tank 16 must be installed in a pit 17.

Figure 9:
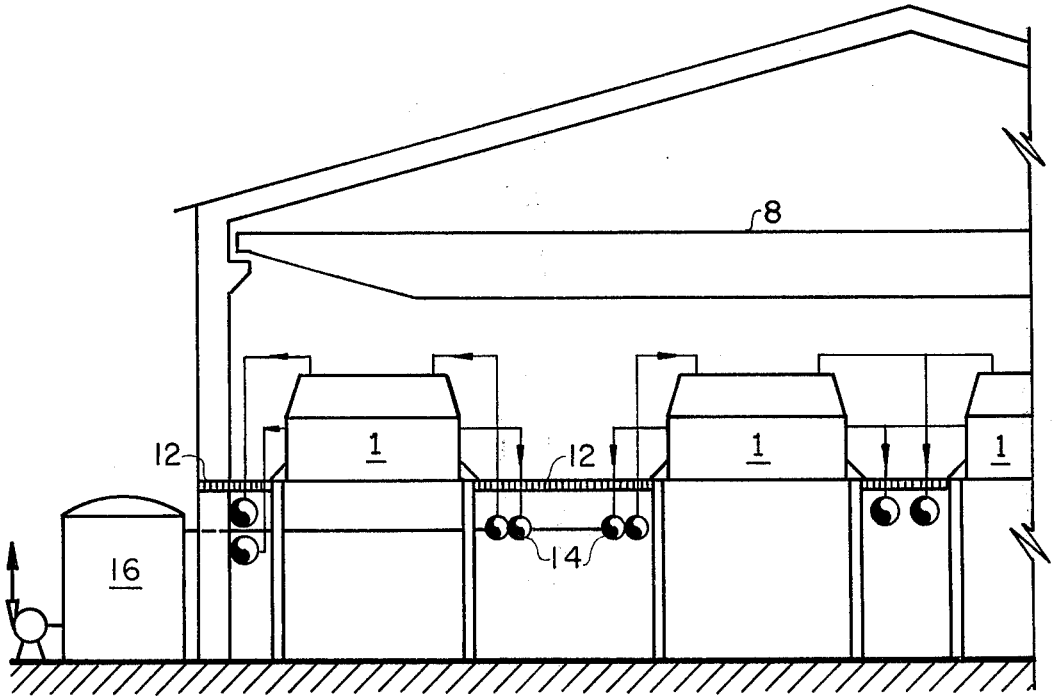

In comparison to the prior art demonstrated in FIG. 8, FIG. 9 shows the arrangement of the cell liquor piping in a cell circuit of this invention. Due to the high position of the cells, collecting pipes and tank can be installed over the floor, avoiding all trenches and pits. All the other piping, for example, for product, utilities, or raw materials can be installed beneath the floor level 1 of the cells too so that no pipe line can interfere in the cell operators and crane area.

Figure 10:
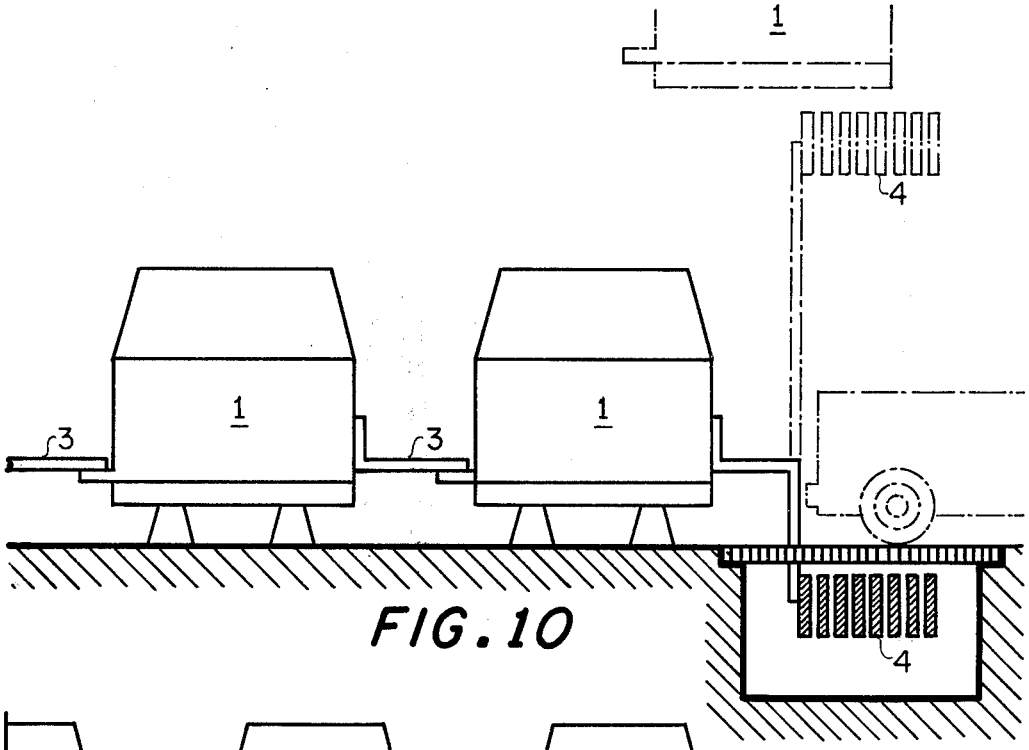
FIGS. 10 and 11: Comparison of cross over busbar arrangement of prior art and this invention

FIG. 10 shows arrangements of the cross over busbars 4 in conventional cell circuits. In case of overhead installing the cross over busbars interfere the crane area. In case of underfloor installing extensive trenches must be used for the reception of the voluminous cross over busbars.

Figure 11:
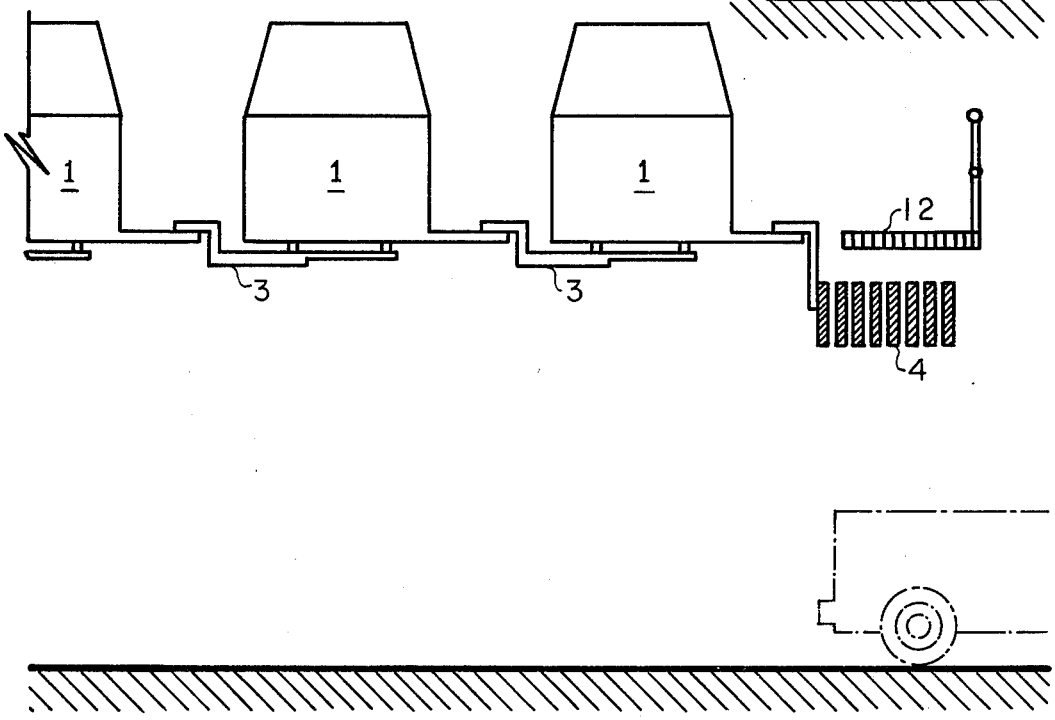

In comparison to the prior art as demonstrated in FIG. 10 in FIG. 11 is shown an installation of the crossover busbars which makes use of the higher position of the cells regarding to a circuit of this invention. The crossover busbars are positioned below the level of the cell gangway 12 and do not interfere with the cell aisle area, or the crane area or the floor area.

The novel circuit of electrolytic cells of the present invention have many other uses. For example, alkali metal chlorates can be produced using the circuit of electrolytic cells of the present invention by further reacting the formed caustic and chlorine outside of the novel circuit of electrolytic cells. In this instance, solutions containing both alkali metal chlorate and alkali metal chloride can be recirculated to the circuit of electrolytic cells for further electrolysis. The circuit of electrolytic cells can be utilized for the electrolysis of hydrochloric acid by electrolyzing hydrochloric acid alone or in combination with an alkali metal chloride. Thus, the novel circuit of electrolytic cells of the present invention is highly useful in these and many other aqueous processes.

While there have been described various embodiments of the present invention, the novel circuit of electrolytic cells described is not intended to be understood as limiting the scope of the present invention. It is realized that changes therein are possible. It is further contended that each component recited in any of the following claims is to be understood as referring to all equivalent components for accomplishing the same results in substantially the same or equivalent manner. The following claims are intended to cover the present invention broadly in whatever forms the principles thereof may be utilized.

We claim:

1. A circuit of electrolytic cells installed in electrical series, comprising:

a plurality of vertical electrode cells whose aspect ratio of cell length to cell width is at least 2:1, said cells being disposed in at least one row so that the anode lead-in and cathode lead-out busbars are disposed along the length of each cell, said cell circuit containing at least one portable jumper switch beneath a cell row and movable along the center line of the cell row, said portable jumper switch having cell connectors on opposite sides, said jumper switch permitting that a cell may be taken out of service by conducting the current through the jumper switch without interrupting continuous operation of the other cells in the circuit thereby ensuring that the electric current flow through said connectors of the jumper switch from one cell to the other cell connected to the jumper switch is rectilinear in the top view of the cell row.

2. A circuit of electrolytic cells according to claim 1 wherein the support means of the cells and the support structure carrying the cells are located outside the switch operating area permitting installation, movement and operation of the portable jumper switch beneath the cell row.

3. A circuit of electrolytic cells according to claim 2 wherein the support structure supporting the cells is also used for supporting the cell gangways.

4. A circuit of electrolytic cells according to claim 2 wherein the support structure carrying the cells is also used for supporting the piping of the cell room.

5. A circuit of electrolytic cells according to claim 1 wherein the anode lead-in and cathode lead-out busbars are uniformly disposed across substantially the entire length of the cells.

6. A circuit of electrolytic cells according to claim 1 wherein the anode lead-in and cathode lead-out busbars are provided with separate electrical contact areas for the cell to cell connection and for the cell to switch connection.

7. A circuit of electrolytic cells according to claim 1 containing at least one portable jumper switch, said jumper switch comprising a plurality of flexible cell connectors, a plurality of switch contacts all evenly disposed across substantially the entire length of the switch corresponding to the length of the cell.

8. A circuit of electrolytic cells according to claim 1 wherein means supporting the crossover busbars are arranged to be located below the level of the cell gangway.

* * * * *